US010286365B2

(12) United States Patent
Guy et al.

(10) Patent No.: US 10,286,365 B2
(45) Date of Patent: May 14, 2019

(54) DISPENSING SYSTEM FOR CAKEABLE MATERIALS

(71) Applicants: David Guy, Maple Grove, MN (US); Jeffrey D. Johnson, Edina, MN (US); Paul Freeberg, South St. Paul, MN (US); Terry Goeman, Minnetonka, MN (US); Lyle Enderson, Anoka, MN (US)

(72) Inventors: David Guy, Maple Grove, MN (US); Jeffrey D. Johnson, Edina, MN (US); Paul Freeberg, South St. Paul, MN (US); Terry Goeman, Minnetonka, MN (US); Lyle Enderson, Anoka, MN (US)

(73) Assignee: KING TECHNOLOGY INC

( * ) Notice: Subject to any disclaimer, the term of this patent is extended or adjusted under 35 U.S.C. 154(b) by 12 days.

(21) Appl. No.: 15/530,222

(22) Filed: Dec. 13, 2016

(65) Prior Publication Data

US 2017/0216783 A1 Aug. 3, 2017

Related U.S. Application Data

(60) Provisional application No. 62/388,549, filed on Feb. 1, 2016.

(51) Int. Cl.
*B01F 1/00* (2006.01)

(52) U.S. Cl.
CPC ..... *B01F 1/0027* (2013.01); *B01F 1/0033* (2013.01); *B01F 2215/0052* (2013.01); *Y10T 137/4891* (2015.04)

(58) Field of Classification Search
CPC ..... B01F 1/0027; B01F 2215/0052; B01F 1/0033; Y10T 137/4891
USPC ..... 137/268
See application file for complete search history.

(56) References Cited

U.S. PATENT DOCUMENTS

| | | | | |
|---|---|---|---|---|
| 4,032,035 | A | 6/1977 | Tepas, Jr. et al. | |
| 4,333,493 | A | 6/1982 | Beiswenger | |
| 4,662,387 | A * | 5/1987 | King, Sr. | C02F 1/688 137/268 |
| 4,867,196 | A | 9/1989 | Zetena | |
| 5,218,983 | A * | 6/1993 | King | B01F 1/00 137/1 |
| 6,241,884 | B1 * | 6/2001 | Hansen | B29C 39/02 137/268 |
| 6,544,415 | B2 * | 4/2003 | King | A01N 25/26 210/205 |
| 6,814,306 | B1 * | 11/2004 | Okubo | B05B 3/04 137/268 |
| 9,725,920 | B2 * | 8/2017 | King et al. | E04H 4/1281 |

* cited by examiner

*Primary Examiner* — Kevin Lee
(74) *Attorney, Agent, or Firm* — Johnson & Phung LLC

(57) ABSTRACT

A dispensing system for delivery of a dispersant from a canister containing an erodible but cakeable water dispersant wherein the cakeable water dispersant in a one piece caked condition falls to a bottom of a divergent walled canister so the water flowing through a bottom portion of the canister continues to maintain erodible contact with the dispersant as the water disperant is consumed.

20 Claims, 1 Drawing Sheet

DISPENSING SYSTEM FOR CAKEABLE MATERIALS

CROSS REFERENCE TO RELATED APPLICATIONS

This application claims priority from provisional application Ser. No. 62/388,549 filed Feb. 1, 2016.

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the difficulties with delivery of erodible materials into a fluid from a canister is that oftentimes the concentration of the materials delivered into the fluid varies in response to various factors besides the flow rate of fluid through the canisters. The problem of incorrect delivery rate may occur with systems for delivery of water dispersant into a body of water, which can be harmful. For example, where the concentration of the dispersant in the body of water needs to be maintained within a range to ensure the safety of the water for either consumption or recreational use such as in swimming pools, spas or the like as well as in systems where the erodible and dissolvable materials are used to maintain systems in a conditioned state to prevent bacterial growth. Since various factors including the type and state of the dispersant materials as well as other factors including the water temperature and water flow rates may have an effect on the proscribed release of dispersant from the dispenser one may not be able to ensure that the dispersant delivery rate remains within an acceptable range.

Typically, in an inline system the water flow rate through the inline dispenser is initially adjusted to deliver a proscribed amount of disperant into the body of water. It is generally assumed that as long as the water flow rate through the canister remains constant the disperant rate from the canister should also remain constant until the dispersant in the dispenser is exhausted. However, since the dispensing material within the canister is generally hidden from view one cannot readily observe if the dispersant is being properly dispensed. For example, in some cases the internal water flow effects such as the Coanda effect may cause water to flow through the passages within the canister without making sufficient contact with the dispersant in the canister. In other cases the state of the dispersant material may cause the dispersant rate to vary by preventing the water from coming into proper contact with the dispersant in the canister. Since such internal water effects may be transient and are not directly viewable in a canister the operator may not know that the concentration of dispersant has changed unless the concentration of dispersant is continually monitored, which in some systems is not feasible or practical. One of the methods of eliminating a problem such as bridging or caking is to change the composition of the dispersant while another may include monitoring temperatures to ensure that changes in temperature of do not result in caking or bridging within the dispenser. Thus, changes in the composition of the dispersant as well as the control of other factors which affect caking such as temperature may be used, however, such solutions can be costly and time consuming.

SUMMARY OF THE INVENTION

A dispensing system for delivery of a dispersant from a canister containing an erodible but cakeable water dispersant wherein the cakeable water dispersant remains in a one piece caked condition as water flows through a bottom portion of the canister. Typically, the water flowing through the dispersant in the bottom of the canister erodes away the lower portion of the caked water dispenser leaving a dispersant bridge in the canister, which can reduce water contact with the dispersant and consequently reduce the rate of delivery of dispersant. In the invention described herein the dispenser cartridge includes a diverging sidewall that allows bridged material to fall downward into the water path at the bottom of the canister thus allowing one to maintain full water contact with the dispersant and maintain the proper delivery rate.

DESCRIPTION OF THE PREFERRED EMBODIMENT

Figure 1:
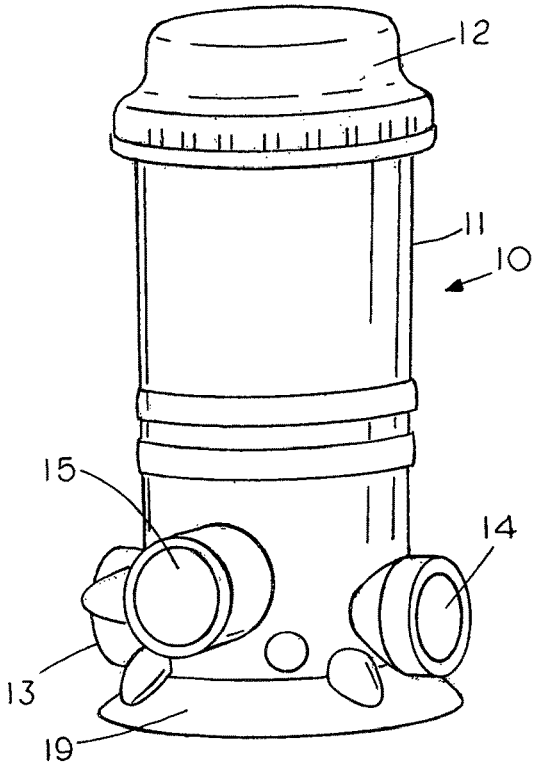
FIG. 1 is a front view of an inline dispensing valve.

FIG. 1 is a front view of an inline dispenser 10 having a removable cap 12 on one end and a cylindrical sidewall 11 supported by a base 19. On one side of housing 11 is an inlet fitting 13 and the opposite side is an outlet fitting 14 for connection of inline dispenser to a fluid line such as found in a water system. Typically, water flows in through inlet fitting 13 and into a chamber in the interior of the inline dispenser 10 and then out through the outlet fitting 14. A rotary valve 15 contains a diverter (not shown) to direct more or less fluid through the chamber in inline dispenser 10. An example of an inline dispenser is shown in King et al U.S. Pat. No. 8,464,743, which is hereby incorporated by reference.

Figure 2:
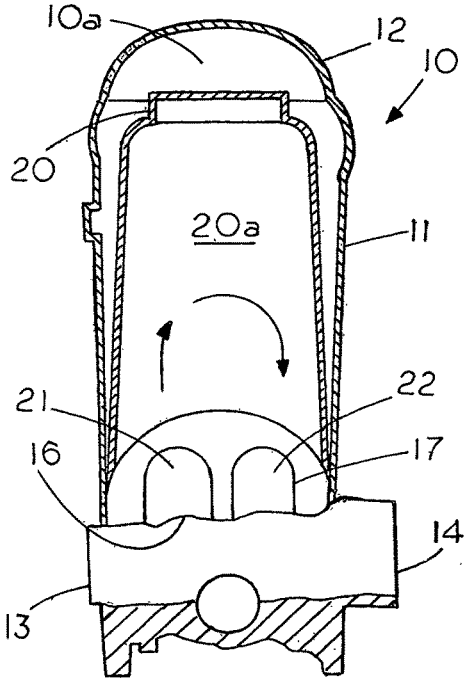
FIG. 2 is a sectional view of an inline dispensing valve with a flow through dispensing canister therein.

FIG. 2 is a sectional view of inline dispenser 10 with a replaceable dispensing canister 20 located in a cylindrical chamber 10*a* in inline dispenser 10. Typically, the canister 20 fits within the cylindrical chamber 10*a* in the inline dispenser 10 with a bottom end of canister 20 having an inlet port 21 in fluid communication with fluid inlet port 16 of inline dispenser housing 11 and an outlet port 22 in fluid communication with fluid outlet port 17 in inline dispenser housing 11 so that water can flow into and out of the dispensing canister 20 as indicated by the flow arrows. Typically, with the presence of a dispersant in the dispensing cartridge the water flows into the dispersant at the bottom of the dispenser cartridge 20.

Figure 3:
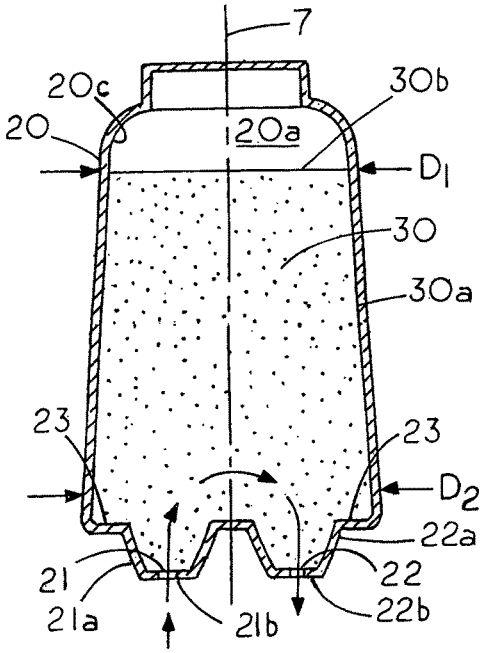
FIG. 3 is a sectional view of a dispensing canister showing a caked or solid water dispersant therein.

In the dispensing phase the fluid, for example water, is directed into inlet fitting 13 and through the ports 16 and 21 and into the chamber 20*a* in canister 20 where a solid dispersant 30 is located therein (FIG. 3). The flowing water contacts the underside of the solid dispersant 30 as the water flows through canister ports 21 and 22. The flowing water caries dispersant out of the canister 20 through ports 22 and 17 where the water containing the dispersant returns to the system through outlet port 14.

FIG. 3 is a sectional view of a dispensing canister 20 of the present invention having a caked water dispersant material 30 in an unspent condition therein. By caked it is meant that the water dispersant material adheres to itself and takes the shape of the interior of the canister once the dispersant materials are placed therein. In this example the canister 20 has a frusto conical shape with the top portion of the canister having a diameter $D_1$ and the lower portion of the canister having a diameter $D_2$ with $D_2$ larger than $D_1$ so that the canister 20 flares or diverges radially outward from the top of the canister to the bottom of the canister. The feature of downward canister divergence together with a smooth or non interfering sidewall 20*c* allows any caked dispensing material 30, which bridges from side to side of the container, to fall into the flow path through the bottom of the canister 20 where it is consumed.

FIG. 3 shows the dispensing material 30, which is located within chamber 20*a*, has a top surface 30*b* and a side surface 30*a* in contact with sidewall 20*c* of canister 20. As pointed out the dispensing material 30 is a cakeable material or solid material, which is water dissolvable as water flows through the canister 20. The arrows in FIG. 3 illustrates that water enters canister 30 in port 21 and flows out port 22. However, oftentimes the dispersant will cake or bridge over the bottom of the container and starve the system of the dispersant since water may flow in and out of the canister with minimal contact with dispersant located in a dispersant bridge. Typically, the cakeable dispersant material 30, which is placed in the cartridge, forms a solid or solid like mass having a side surface 30*a*, which is flush with interior wall 20*c*. Examples, of water dissolvable cakeable material include BCDMH (1-Bromo-3chloro-5,5-dimethylhydantoin), DBDMH (1,3-Dibromo-5,5-dimethylhydantoin), DCDMH (1,3-Dichloro-5,5-dimethylhydantoin), DBNPA (2,2,dibromo-3-nitrilo-proprionamide) and Trichloroisocyanuric acid.

Figure 4:
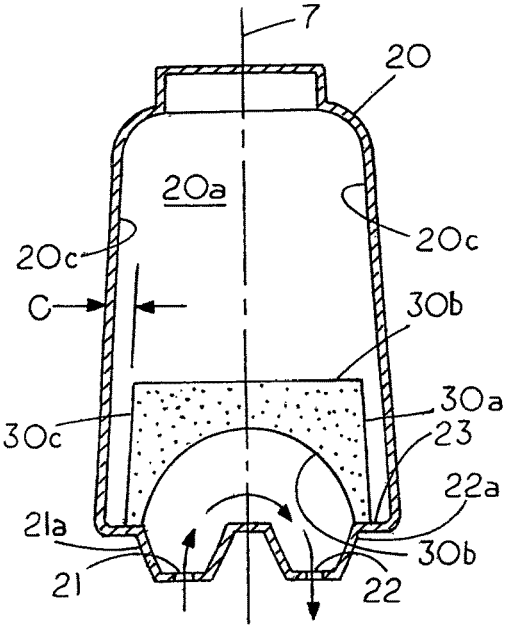
FIG. 4 is a sectional view of the dispensing cartridge of FIG. 3 showing the displacement of the dispersant after a portion of the caked water dispersant has been eroded by water flowing through the bottom of the dispensing canister.

FIG. 4 is a sectional view of the dispensing cartridge 20 of FIG. 3 with the dispersant 30 therein in a partially spent condition after a portion of the bridged caked water dispersant 30 has been eroded by water flowing through the lower portion of canister chamber 20*a*. Note the curved under surface 30*b* formed by the water flowing in and out of the ports 21 and 22. Typically, the water contacts the bottom of the cakeable dispersant 30 and removes material from the bottom or underside of the cakeable material, which forms a cakeable dispersant bridge having an actuate underside 30*b*. In the present invention the shape of the canister is such that the canister diverges from the top to the bottom of the canister. With the bottom of the dispensing cartridge 20 larger than the top of the dispensing cartridge 20 the bridged material 30 is free to fall to the bottom of the dispensing cartridge 20 as illustrated in FIG. 4. Consequently, the cakeable dispersant material 30, which takes the shape of the interior surface 20*a* and has a specific gravity greater than 1, falls to the bottom of dispensing cartridge 20 as the bottom portion of the material 30 is consumed. That is, the caked or solid dispersant 30 is free to fall to the bottom of the dispenser cartridge 20 as shown in FIG. 4, since the sidewall of canister 20 diverges outward. A feature of the canister divergence is that it maximizes water contact with the dispensable material as the water flows through the bottom of the canister since the dispensable material does not get hung up at the top of the dispensing cartridge 20 where there is less water contact with the dispersant than at the bottom of the dispenser cartridge 20. Consequently, the rate of delivery of material remains constant since one can maintain a large contact area between the flowing water and the dispersant as dispensable material is continually being brought to the bottom of the dispensing cartridge 20 which typically provides greater interaction between the flowing water and the dispersant.

As described herein caking may occur when the dispensable material is placed in a dispenser cartridge or the caking may occur for various reasons, for example, such as contact with the water in the dispensing cartridge. Since the caking may effect the dispensing rate one approach is to prevent caking by changing the content of the dispensable materials, however, it may not always be feasible to change the content of the dispensing material in order to avoid dispensing problems associated with caking. Another problem with caked material, which is shown in FIG. 3, is that dispensing material may cake and form a solid arch over the inlet port and outlet port if the water is directed into and out of the bottom of the dispensing cartridge. The caked bridge minimizes the contact of flowing water to the dispensing material and thus changes the rate of dispensing when the water is directed through the bottom of the dispensing cartridge. It should be noted that in some instances the dispensable material may not be caked when it is placed a dispensing cartridge but becomes caked after exposure to the water. In either case the caking of the material may lead to a disruption of the dispensing rate and consequently an alternating of the available dispersant in the body of water connected to the inline system. In the invention described herein the problem associated with caking of the materials within the dispenser has been overcome through the feature of formation of a dispensing cartridge that has a top region that diverges to a lower region as shown in FIG. 1 so that even if dispensing material cakes within the dispensing cartridge there are no protrusions in the sidewall to prevent the caked dispensing material from falling into the flow region within the lower portion of the dispensing cartridge.

In the example shown in FIG. 3 the interior sidewall 20*c* of the dispensing canister 20 diverges or flares radially outward in a downward direction, which is evidenced by $D_2$ being larger than $D^{1'}$ to thereby minimize or eliminate sidewall regions or sidewall protrusions that can physical engage the caked bridged material within the dispensing cartridge 20 to prevent a falling displacement of the caked or solidified disperant therein.

In the example shown in FIG. 3 a single fluid inlet port 21 is located at a peripheral edge of the dispensing canister 20 and offset from the central axis 7 with the fluid inlet port 21 located at a bottom surface 21*b* of a diverging funnel shaped inlet 21*a* extending outward from the peripheral bottom portion 23 of the dispensing canister 20 and a single fluid outlet port 22 located at a peripheral edge of the canister 20 and offset from the central axis 7 with a bottom surface 22*b* of a diverging funnel shaped outlet 22*a* extending outward from the bottom portion 23 of canister 20 with the fluid inlet port 21 of the canister 20 in fluid communication with the inline dispenser and the fluid outlet port 22 of the canister in fluid communication with the fluid outlet port of the inline dispenser. The arrows in FIG. 3 illustrating a fluid flowing from the inline dispenser 10 being at least partially diverted through the cakeable dispersant 30 in the bottom portion of the canister 20.

Thus, the feature of the removal of physical impediments such as wall protrusions and the use of a converging sidewall within the dispensing cartridge minimize or eliminates physical barriers to the caked dispersant becoming hung up within the dispensing cartridge. In addition another feature of the invention is the use of a dispensing interior cartridge with a smooth sidewall that reduces the frictional forces or other types of adhesion forces between the exterior surface of the caked dispersant and the sidewall to a level such that the gravitational forces on the caked disperant, which are due to the mass of the caked dispersant, are sufficient to overcome any of the frictional or other types of adhesion forces that may normally cause the caked disperant to adhere to the wall. Thus with some dispersants a downward diverging sidewall without physical impediments to obstruct caked dispersal movement may be sufficient to prevent disruption in the dispersal rate and other one may want to ensure that any forces between a sidewall of the caked disperant is insufficient to hold the caked disperant in place as a bottom portion of the caked disperant that supports the caked disperant is removed to water flow through the bottom of the dispensing cartridge.

We claim:

1. A dispensing system for controlled delivery of cakeable dispensable materials to a body of water comprising:

an inline dispenser having a chamber with a closed top end;

a dispensing canister having a central axis located in said chamber with said dispensing canister having an internal compartment formed by an interior sidewall that flares radially outward in a downward direction a fluid inlet fitting in the inline dispenser for directing water upward into the dispensing canister;

a fluid outlet fitting in the inline dispenser for directing water out of the dispensing canister;

a cakeable dispersant located in said dispensing canister chamber, said dispensing canister interior sidewall with the interior sidewall comprising a non interfering sidewall with a top portion of the of the non interfering sidewall having a smaller cross sectional dimension than a bottom portion of the non interfering sidewall for the cakeable dispersant located at the top portion of the dispensing canister to fall to the bottom portion of the dispensing canister; and a single fluid inlet port located at a peripheral edge of the dispensing canister and offset from the central axis, said fluid inlet port located at a bottom of a diverging funnel shaped inlet extending outward from the bottom portion of the dispensing canister and a single fluid outlet port located at a peripheral edge of the dispensing canister and offset from the central axis with a bottom of a diverging funnel shaped outlet extending outward from the bottom portion of the dispensing canister with the fluid inlet port of the dispensing canister in fluid communication with the fluid inlet port of the inline dispenser and the fluid outlet port of the dispensing canister in fluid communication with the fluid outlet port of the inline dispenser whereby a fluid flowing through the inline dispenser can at least be partially diverted through the cakeable dispersant falling to the bottom portion of the dispensing canister.

2. The dispensing system of claim 1 wherein the canister has a frusto conical shape.

3. The dispensing system of claim 1 wherein the cakeable dissolvable dispersant comprise a mineral, a pesticide, a corrosion control chemical, a water scale treatment chemical or a chemical to control a biofilm in a water treatment system.

4. The dispensing system of claim 1 wherein a bottom fluid inlet of the canister is spaced from a bottom fluid outlet of the canister so that a fluid flowing through the canister flows past the cakeable dispersant at the bottom portion of the canister chamber.

5. The dispensing system of claim 1 wherein the sidewall of the canister is smooth.

6. The dispensing system of claim 1 wherein the cakeable dispersant comprise a cakeable dissolvable dispersant that remains in a caked condition as a portion of the cakeable dissolvable dispersant is eroded by the flow of water through the canister.

7. The dispensing system of claim 6 wherein the cakeable dissolvable dispersant has a shape that conforms to the sidewall of the canister.

8. The dispensing system of claim 7 wherein the cakeable dissolvable dispersant has a specific gravity greater than one.

9. The dispensing system of claim 8 wherein the cakeable dissolvable dispersant erodes from a bottom surface of the cakeable dissolvable dispersant while a side surface of the cakeable dissolvable dispersant maintains in contact with an interior sidewall of the canister.

10. The dispensing system of claim 9 wherein the interior sidewall of the canister is in contact with a side surface of the cakeable dissolvable dispersant.

11. The dispensing system of claim 10 wherein the cakeable dissolvable dispersant has a weight that causes the cakeable dissolvable dispersant to migrate toward a bottom of the canister as a bottom portion of the cakeable dissolvable dispersant is eroded by water flowing through the bottom of the canister.

12. A dispensing canister for maintaining a correct delivery rate even though a dispersant therein may form a dispersant bridge within the dispensing canister comprising;

a housing having a chamber therein with the chamber defined by a closed top member and a bottom member;

a flared non interfering sidewall joining the top member to the bottom member with the sidewall diverging from the top member to the bottom member, said non interfering sidewall allowing a caked dispensing material which bridges from side to side of the canister, to fall into a flow path through the bottom of the canister where the caked dispensing material is contacted by water flowing through the bottom of the canister; and a diverging bottom inlet and a converging bottom outlet in the bottom member of the dispensing canister for directing a fluid into an underside of a caked dispensing material in the chamber whereby the caked dispensing material in an undissolved state falls toward the bottom of the chamber as material is eroded from the underside of the caked dispensing material.

13. A dispensing system for controlled delivery of cakeable dispensable materials or non-cakeable materials that have difficulty in falling to a bottom of a dispenser where the materials can be dispensed into a body of water comprising:

an inline dispenser having a canister chamber;

a fluid inlet in the inline dispenser for directing water upward into the canister chamber;

a fluid outlet in the inline dispenser for directing water downward out of the canister chamber;

a canister located in said canister chamber, said canister having a flared, non-interfering sidewall with a top portion of the canister having a smaller cross sectional dimension than the bottom portion of the canister;

a cakeable or a non-cakeable dissolvable dispersant located in said canister chamber;

a fluid inlet and a fluid outlet on the canister comprising a screen or open bottom portion of the canister whereby a fluid flowing through the inline dispenser valve can at least be partially diverted proximate the cakeable or the non-cakeable dispersant in the canister chamber.

14. A dispensing container for maintaining a stable dispersant delivery rate as a bridgeable dispersant contained therein is incrementally decreased through a fluid flowing through the container comprising:

a housing having a top end and a bottom end with an internal downwardly diverging non interfering sidewall extending from said top end to said bottom end to form a downwardly diverging dispersant compartment therein;

a fluid dissolvable bridgeable dispersant that adheres to itself in the presence of a fluid to form a dispersant bridge located within the dispersant compartment with the dispersant extending laterally across said downwardly diverging dispersant compartment and in contact with the internal downwardly diverging non-interfering sidewall but without adhering to the sidewall so that a weight of the dispersant is sufficient to gravity feed the dispersant to a bottom of the dispensing container whether the dispersant is in either a bridged condition or a non bridged condition;

a peripheral fluid inlet passage located at the bottom of the dispenser container with said fluid inlet passage directing the fluid into the fluid dissolvable bridgeable dispersant in the dispersant compartment to thereby incrementally carry dispersant away from a bottom end of the dispersant compartment; and a peripheral fluid outlet passage located in said housing for transporting the fluid with the dispersant therein out of the dispenser container.

15. The dispensing container of claim 14 wherein the internal downwardly diverging non-interfering sidewall forming the dispersant compartment therein having a bottom cross sectional area larger than a top cross sectional area of the dispersant compartment.

16. The dispensing container of claim 14 wherein the top end of the housing and the internal downwardly diverging non-interfering sidewall are closed and the bottom end has an inlet and an outlet port for water to flow therethrough.

17. The dispensing container of claim 14 wherein a specific gravity of the dispersant is greater than a specific gravity of the fluid so that the weight of the dispersant causes the dispersant to fall into the fluid at the bottom of the dispersant compartment.

18. A method of incrementally delivering a dispensable material into a body of water containing a water dispensable material when the dispensable material has a tendency to bridge as a fluid flows through a bottom portion of the water dispensable material comprising:

placing the water dispensable material into a dispensing cartridge having a smooth internal side wall that continually diverges outward from a top end of the dispensing cartridge to a bottom end of the dispensing cartridge with the bottom end of the dispensing cartridge having a peripheral fluid inlet port and a fluid outlet port; and placing the dispensing cartridge with the peripheral fluid inlet port and fluid outlet port into an inline dispenser having an inlet port and an outlet port;

bringing the fluid inlet port and fluid outlet port in the dispensing cartridge into fluid communication with the inlet port and the outlet port of the inline dispenser so that the fluid flows into and out of the bottom of the dispensing cartridge to remove the dispensable material from a bottom portion of the dispensable material in the dispensing cartridge while releasing any bridged dispensable material suspended over a bottom end of the dispensing cartridge through a gravitational force on the bridged dispensable material; and maintaining the fluid flowing through the bottom of the dispensing cartridge as the smooth internal sidewall of the dispensing cartridge directs the bridged dispensable material into the fluid flowing through the bottom of the dispensing cartridge.

19. The method of claim 18 including the step of directing a water flow into the inline dispenser while retaining the dispensing cartridge in a fixed position within the inline dispenser.

20. The method of claim 18 wherein the step of placing the dispensing cartridge into the inline dispenser comprises the step of inserting the dispensing cartridge having a frusto conical shape into the inline dispenser with a larger end of the dispensing cartridge located below a smaller end of the dispensing cartridge so that the dispensable material therein can fall downward into the fluid flowing through the bottom of the dispensable canister even though the dispensable material adheres to itself and forms a bridge over the fluid inlet and the outlet port of the dispensing cartridge.

* * * * *